US007498995B2

(12) United States Patent
Kim et al.

(10) Patent No.: US 7,498,995 B2
(45) Date of Patent: Mar. 3, 2009

(54) UWB ANTENNA HAVING 270 DEGREE COVERAGE AND SYSTEM THEREOF

(75) Inventors: Yong-jin Kim, Seoul (KR); Do-hoon Kwon, Seoul (KR); Young-eil Kim, Suwon-si (KR); Seong-soo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 44 days.

(21) Appl. No.: 11/353,989

(22) Filed: Feb. 15, 2006

(65) Prior Publication Data

US 2006/0181471 A1 Aug. 17, 2006

(30) Foreign Application Priority Data

Feb. 15, 2005 (KR) ..... 10-2005-0012380

(51) Int. Cl.
*H01Q 13/08* (2006.01)
*H01Q 13/10* (2006.01)

(52) U.S. Cl. ..... 343/770; 343/786

(58) Field of Classification Search ..... 343/767, 343/770, 786

See application file for complete search history.

(56) References Cited

U.S. PATENT DOCUMENTS 6,246,377 B1 * 6/2001 Aiello et al. ..... 343/770
6,292,153 B1 9/2001 Aiello et al.

FOREIGN PATENT DOCUMENTS

| | | | |
|---|---|---|---|
| JP | 02-029006 | A | 1/1990 |
| JP | 2003-037434 | A | 2/2003 |
| JP | 2003-101337 | A | 4/2003 |
| JP | 2004-515951 | A | 5/2004 |
| JP | 2006-033837 | A | 2/2006 |
| KR | 2002-0090135 | A | 11/2002 |
| WO | 01/69723 | A1 | 9/2001 |

* cited by examiner

*Primary Examiner*—Michael C Wimer
(74) *Attorney, Agent, or Firm*—Sughrue Mion, PLLC

(57) ABSTRACT

An ultra wide band antenna having a 270° coverage and a system thereof. The ultra wide band antenna includes a dielectric substrate, two Vivaldi horn radiators attached to the dielectric substrate and including central axes orthogonal to each other, and a single radiator coupled to the two Vivaldi horn radiators. The ultra wide band antenna system includes: a first ultra wide band antenna including a dielectric substrate, two Vivaldi horn radiators attached to the dielectric substrate and including central axes orthogonal to each other, and a single radiator coupled to the two Vivaldi horn radiators; and a second ultra wide band antenna including a dielectric substrate, two Vivaldi horn radiators attached to the dielectric substrate and including central axes orthogonal to each other, and a single radiator coupled to the two Vivaldi horn radiators, positioned on an identical plane to the first ultra wide band antenna, and forming a line symmetric structure together with the first ultra wide band antenna.

12 Claims, 6 Drawing Sheets

UWB ANTENNA HAVING 270 DEGREE COVERAGE AND SYSTEM THEREOF

CROSS-REFERENCE TO RELATED APPLICATIONS

This application claims priority from Korean Patent Application No. 10-2005-0012380 filed Feb. 15, 2005, in the Korean Intellectual Property Office, the disclosure of which is incorporated herein by reference in its entirety.

BACKGROUND OF THE INVENTION

1. Field of the Invention

Apparatuses and methods consistent with the present invention relate to an ultra wide band (UWB) antenna and a system thereof, and more particularly, to a UWB antenna having a 270° coverage and a system thereof.

2. Description of the Related Art

The use of antennas in cellular phones, radios, televisions, computer networks, and the like has been generalized. Antennas are systems including conductors used for transmitting and receiving radio waves or other electromagnetic waves by wire.

However, many of these antennas produce resonances only when operating in a band of only several percentages. Such a narrow band width antenna may fully satisfy a single frequency or narrow band application devices. Antennas satisfiably functioning in a highly wide frequency band are generally called UWB antennas.

These UWB antennas are mounted in wireless communication devices such as digital televisions (TVs), settop boxes, or cellular phones and enables data to be quickly transmitted and/or received using a UWB. Research and development on planar type UWB antennas have been made because of the ease of mounting of the planar type UWB antennas. However, in a case where such a planar type UWB antenna is mounted in a digital TV or a settop box, a null area is generated due to a reduction in a radiation gain of the planar type UWB antenna toward both edges in an edge-on direction with respect to an electronic device mounting the planar type UWB antenna. A signal level is low in such a null area, and thus communications are not performed. Therefore, an antenna and an antenna system complementing the null area are required.

FIG. 1A is a view illustrating a wide band notch antenna disclosed in U.S. Pat. No. 4,843,403. Referring to FIG. 1A, main beams are radiated in edge-on directions 100.

FIG. 1B is a view illustrating a wide band notch antenna disclosed in U.S. Pat. No. 6,292,163 B1. Referring to FIG. 1B, the wide band notch antenna uses two notches so as to have radiation directions 130 and 160. However, a null area 190 is generated between the radiation directions 130 and 160.

FIG. 2 is a view illustrating a null area generated in an electronic device adopting a conventional UWB antenna. As shown in FIG. 2, in a case where a planar type UWB antenna 200 is mounted in an electronic device such as a conventional digital TV or a settop box, a main radiation direction 230 exists, and a null area is generated toward a side direction 250.

SUMMARY OF THE INVENTION

Accordingly, the present invention has been made to solve the above-mentioned problems, and an aspect of the present invention provides a UWB antenna having a 270° coverage so as to minimize a null area in an electronic device and a system thereof.

According to an aspect of the present invention, there is provided an ultra wide band antenna including: a dielectric substrate; two Vivaldi horn radiators attached to the dielectric substrate and including central axes orthogonal to each other; and a single radiator coupled to the two Vivaldi horn radiators.

According to another aspect of the present invention, there is provided an ultra wide band antenna system including: a first ultra wide band antenna including a dielectric substrate, two Vivaldi horn radiators attached to the dielectric substrate and including central axes orthogonal to each other, and a single radiator coupled to the two Vivaldi horn radiators; and a second ultra wide band antenna including a dielectric substrate, two Vivaldi horn radiators attached to the dielectric substrate and including central axes orthogonal to each other, and a single radiator coupled to the two Vivaldi horn radiators, positioned on an identical plane to the first ultra wide band antenna, and forming a line symmetric structure together with the first ultra wide band antenna. A distance between the first and second ultra wide band antennas may be adjusted. In the line symmetric structure, the two Vivaldi horn radiators may each have a 270° coverage. The first and second ultra wide band antennas may horizontally rotate depending on communication environments.

According to still another aspect of the present invention, there is provided a settop box including the ultra wide band antenna system and radiating a signal using the ultra wide band antenna system.

BRIEF DESCRIPTION OF THE DRAWINGS

The above and other aspects of the present invention will be more apparent by describing exemplary embodiments of the present invention with reference to the accompanying drawings, in which.

DETAILED DESCRIPTION OF THE EXEMPLARY EMBODIMENTS

Figure 1A:
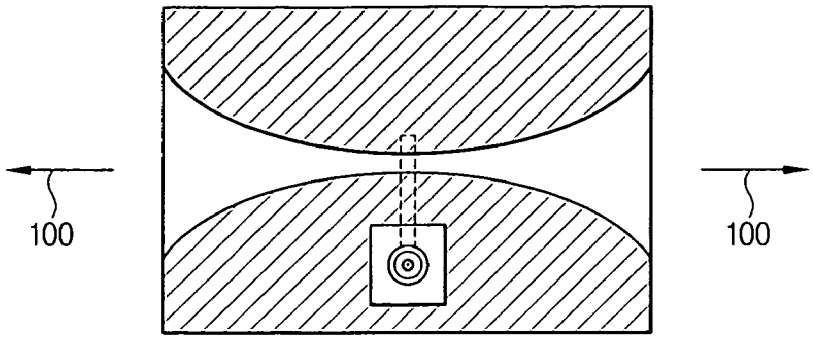
FIG. 1A (RELATED ART)
FIG. 1A is a view illustrating an example of a conventional wide band notch antenna.
Figure 1B:
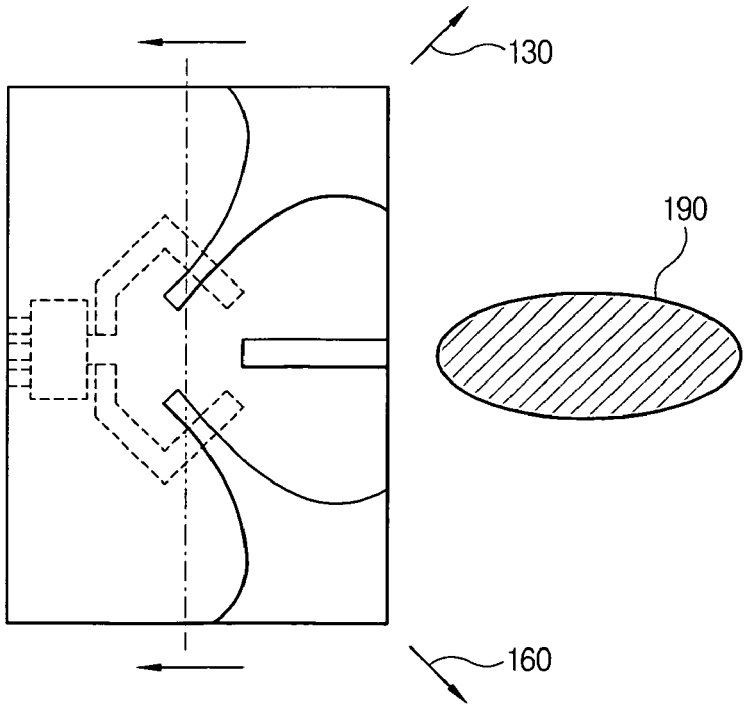
FIG. 1B (RELATED ART)
FIG. 1B is a view illustrating another example of a conventional wide band notch antenna.
Figure 2:
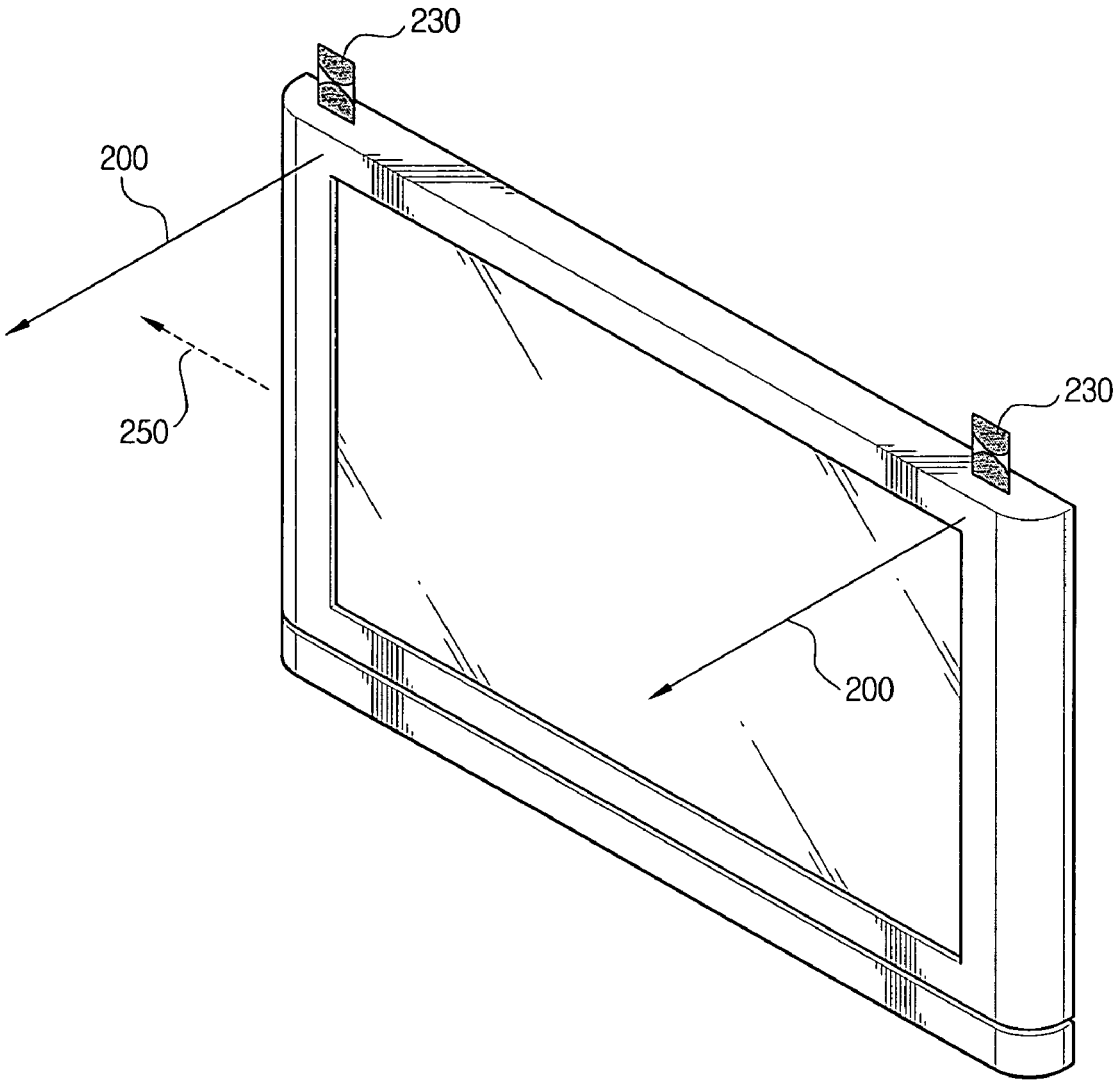
FIG. 2 (RELATED ART)
FIG. 2 is a view illustrating a null area in an electronic device adopting a conventional UWB antenna.

Exemplary embodiments of the present invention will be described in greater detail with reference to the accompanying drawings.

In the following description, same drawing reference numerals are used for the same elements even in different drawings. The matters defined in the description such as a detailed construction and elements are provided to assist in a comprehensive understanding of the invention. Thus, it is apparent that the present invention can be carried out without those defined matters. Also, well-known functions or constructions are not described in detail since they would obscure the invention in unnecessary detail.

Figure 3A:
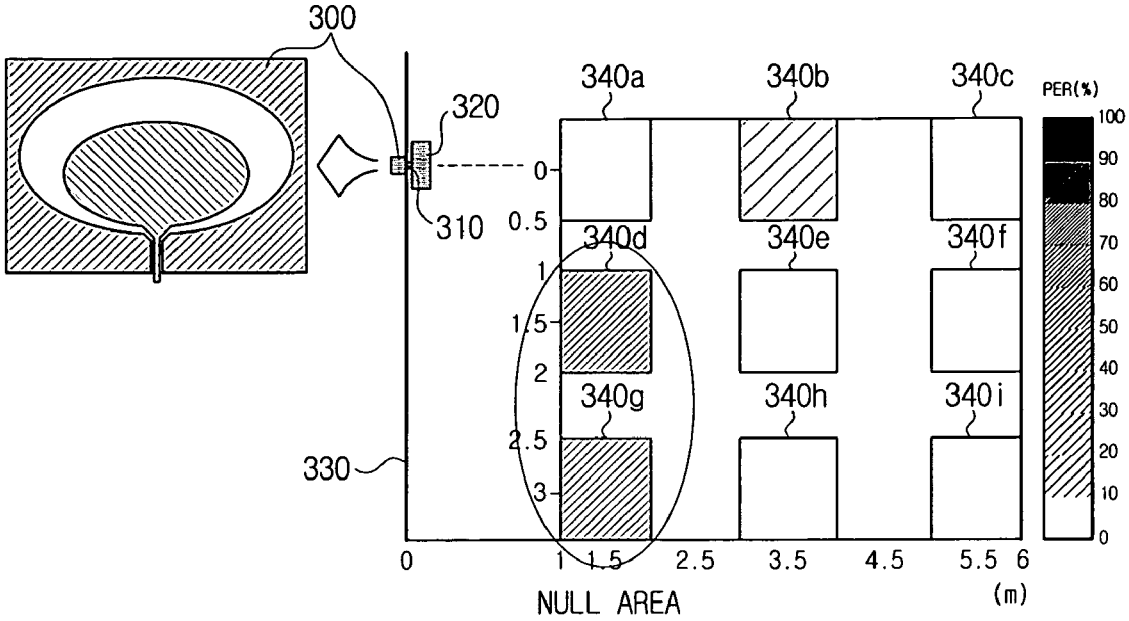
FIG. 3A (RELATED ART)
FIG. 3A is a schematic view illustrating an experiment for measuring packet error rates with respect to an existing planar type UWB antenna and measured values.

FIG. 3A is a schematic view illustrating an experiment for measuring packet error rates with respect to an existing planar type UWB antenna and measured values. Referring to FIG. 3A, a planar type UWB antenna 300, a connector 310, and a UWB transmitter 320 are used to measure packet error rates with respect to the planar type UWB antenna 300. The planar type UWB antenna 300, the connector 310, and the UWB transmitter 320 are attached on an upper portion of a wall 330. A measurement area is divined into areas 340*a* through 340*i*, and then packet error rates are measured in the areas 340*a* through 340*i*.

Packet error rates in the areas 340*a*, 340*c*, 340*e*, 340*f*, 340H, and 340*i* approach 0%. The packet error rate in the area 340*b* is about 5%, the packet error rate in the area 340*d* approaches 40%, and the packet error rate in the area 340*g* approaches 30%. In other words, in the case of the planar type UWB antenna 300, a null area is formed in the areas 340*d* and 340*g*.

Figure 3B:
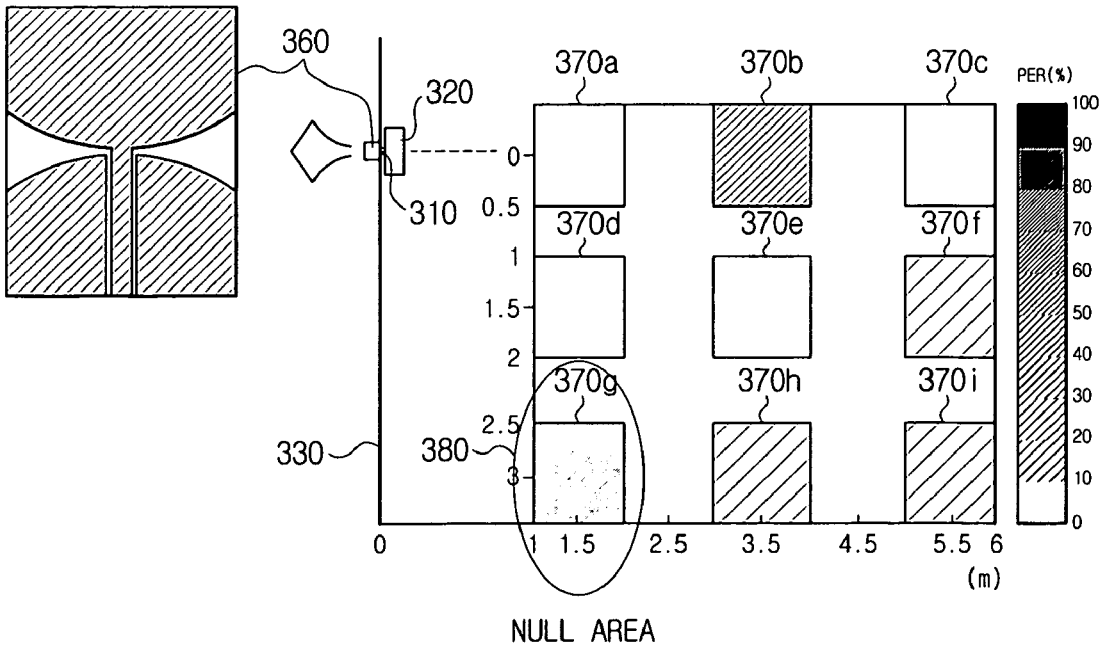
FIG. 3B (RELATED ART)
FIG. 3B is a view illustrating an experiment for measuring packet error rates with respect to an existing dipole type UWB antenna and measured values.

FIG. 3B is a view illustrating an experiment for measuring packet error rates with respect to an existing dipole type UWB antenna and measured values. Referring to FIG. 3B, a dipole type UWB antenna 360, a connector 310, and a UWB transmitter 320 are used to measure packet error rates with respect to the dipole type UWB antenna 360. The dipole type UWB antenna 360, the connector 310, and the UWB transmitter 320 are attached on an upper portion of a wall 330. A measurement area is divined into areas 370*a* through 370*i*, and then packet error rates are measured in the areas 340*a* through 340*i*.

Packet error rates measured in the areas 370*a*, 370*c*, 340*d*, and 340*e* approach 0%. However, packet error rates measured in the area 370*f*, 370*h*, and 370*i* approach 5%. A packet error rate measured in the area 370*b* approaches 30% and a packet error rate measured in the area 370*g* approaches 87%. In other words, in the case of the dipole type UWB antenna 360, a null area is formed in the area 370*g*.

Figure 4A:
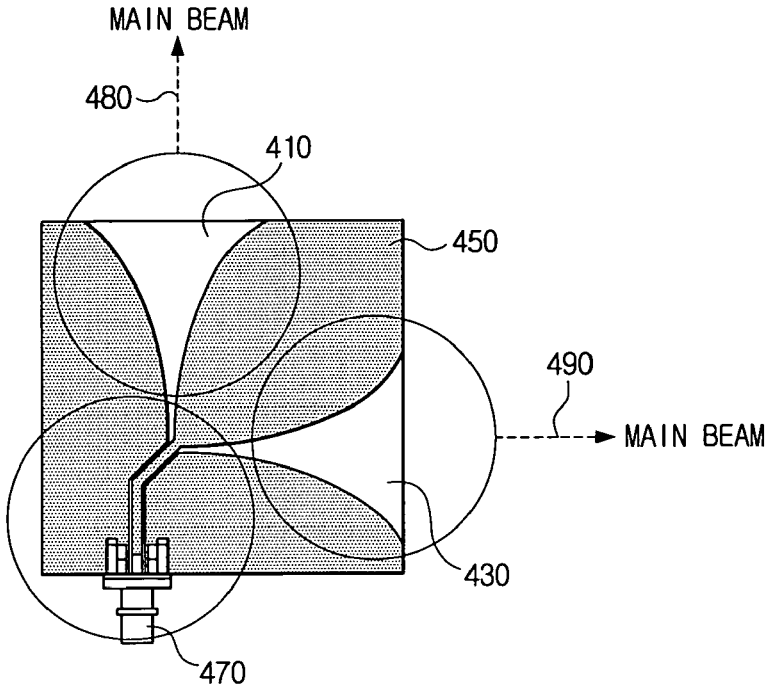
FIG. 4A is a view illustrating a UWB antenna having a 270° coverage according to an exemplary embodiment of the present invention.

FIG. 4A is a view illustrating a UWB antenna having a 270° coverage according to an exemplary embodiment of the present invention. Referring to FIG. 4A, the UWB antenna includes a first Vivaldi horn radiator 410, a second Vivaldi horn radiator 430, a dielectric substrate 450, and a radiator 470. In the UWB antenna shown in FIG. 4A, the radiator 470 is coupled to the first and second Vivaldi horn radiators 410 and 430 so as to radiate beams to the first and second Vivaldi horn radiators 410 and 430. As a result, two main beams are generated by the first and second Vivaldi horn radiator 410 and 430 in two directions. In other words, the first Vivaldi horn radiator 410 radiates a first main beam 480, and the second Vivaldi horn radiator 430 radiates a second main beam 490.

Figure 4B:
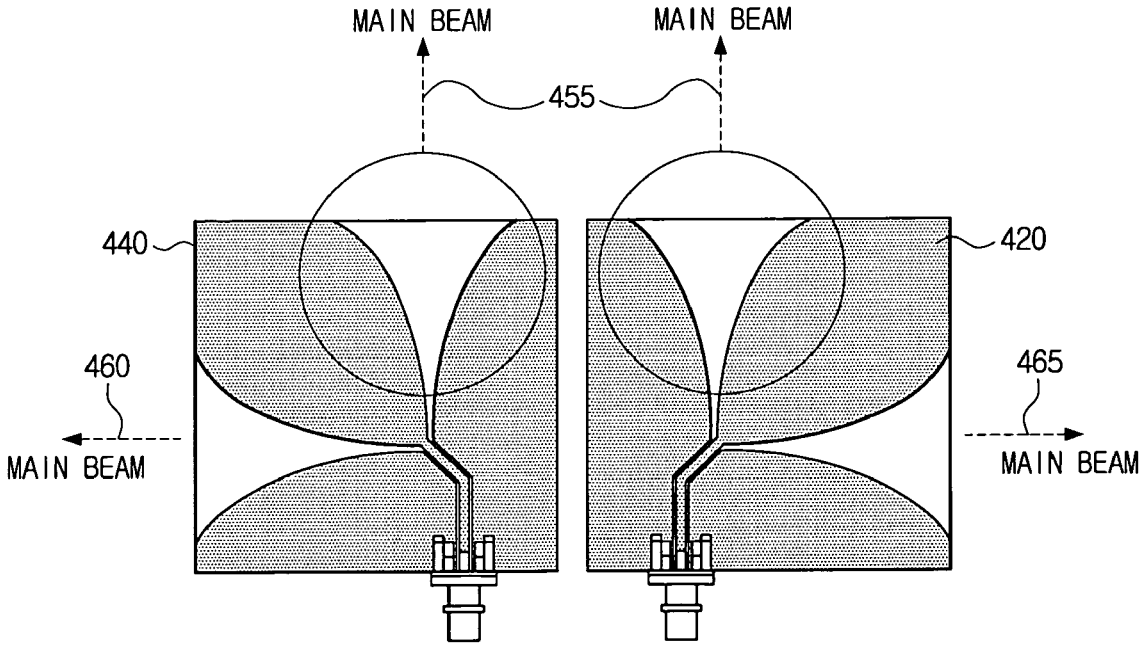
FIG. 4B is a view illustrating a symmetric structure of a UWB antenna system having a 270° coverage according to an exemplary embodiment of the present invention.

FIG. 4B is a view illustrating a symmetric structure of a UWB antenna system having a 270° coverage according to an exemplary embodiment of the present invention. Referring to FIG. 4B, a UWB antenna 420 having a 270° coverage forms a line symmetric structure on the same plane together with a UWB antenna 440 having a 270° coverage. Thus, a UWB antenna system having a 270° coverage according to an exemplary embodiment of the present invention has first through third radiation directions 455, 460, and 465. As a result, the UWB antenna system has the 270° coverage.

Figure 5A:
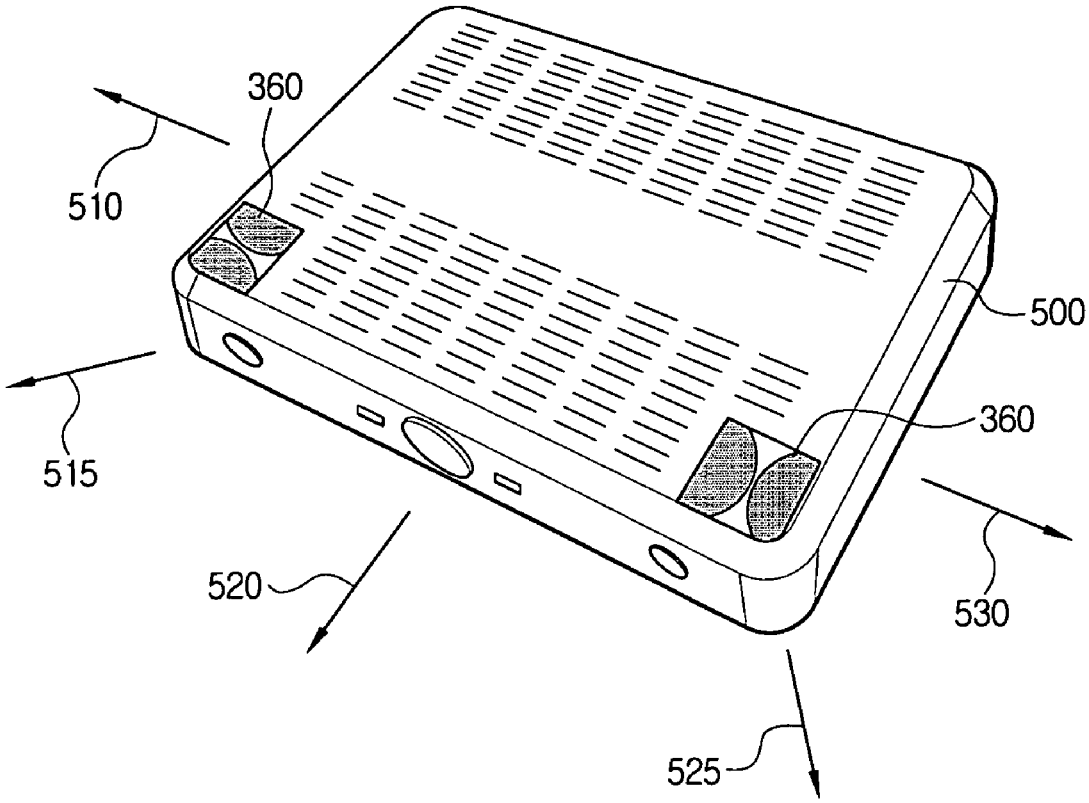
FIG. 5A (PRIOR ART)
FIG. 5A is a schematic view illustrating an experiment for measuring packet error rates in a structure in which two existing dipole type UWB antennas are attached to a settop box and measured values.

FIG. 5A is a view illustrating an experiment for measuring packet error rates of a structure in which two existing dipole type UWB antennas are attached to a settop box and measured values. As shown in FIG. 5A, a settop box 500 and two dipole type UWB antennas 360 are used for the experiment.

One of the two dipole type UWB antennas 360 is attached to one side of a front end of an upper surface of the settop box 500 so as to have a configuration enabling a 270° coverage, and the other one of the two dipole type UWB antenna 360 is attached to an other side of the front end at an angle of 90° with the one.

Analyzing the measured values, a packet error rate measured in a left direction 510 is 0.13%, a packet error rate measured in a left 45° direction 515 is 1.13%, and a packet error rate measured in a central direction 520 is 0.83%. A packet error rate measured in a right 45° direction 525 is 1.77%, and a packet error rate measured in a right direction 530 is 39.71%.

Figure 5B:
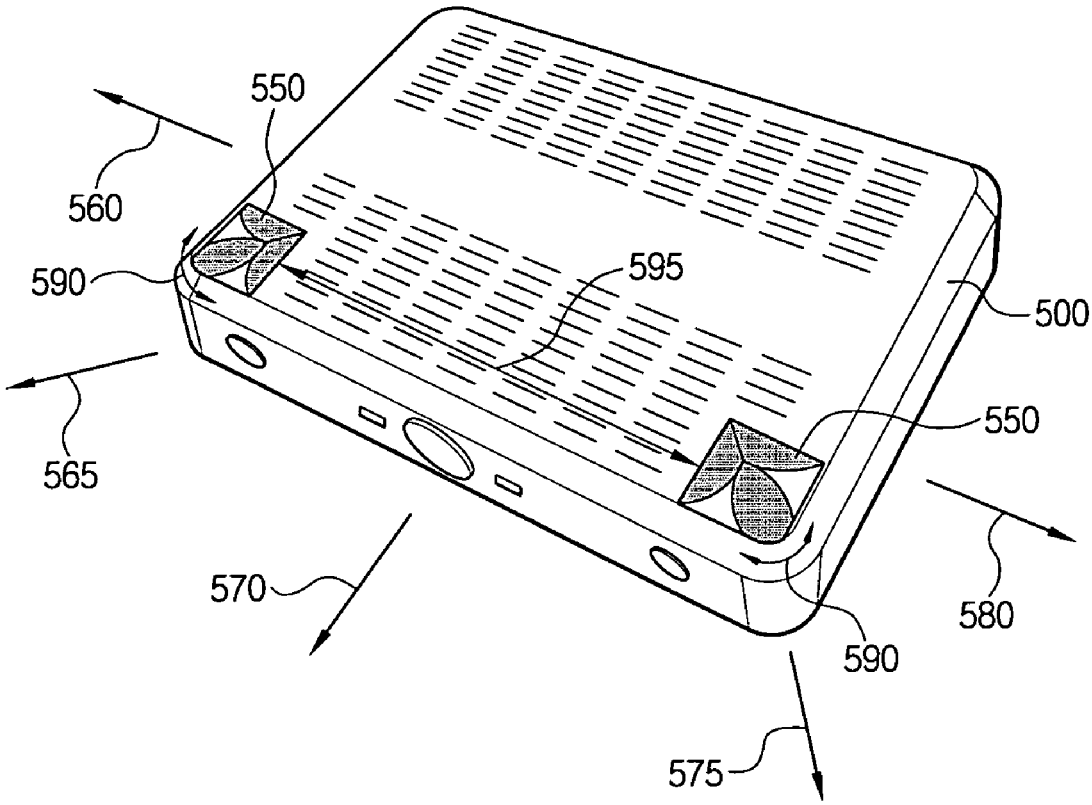
FIG. 5B is a schematic view illustrating an experiment for measuring packet error rates in a structure in which a UWB antenna system having a 270° coverage according to an exemplary embodiment of the present invention is attached to a settop box and measured values.

FIG. 5B is a view illustrating an experiment for measuring packet error rates of a structure in which a UWB antenna system having a 270° coverage according to an exemplary embodiment of the present invention is attached to a settop box and measured values. Referring to FIG. 5B, a settop box 500 and two UWB antennas 550 having a 270° coverage are used for the experiment. A first one of the two UWB antennas 550 is attached to one side of a front end of an upper surface of the settop box 500, and a second one of the UWB antennas 550 is attached to an other side of the front end to be symmetric to the first UWB antenna 550.

Analyzing the measured values, a packet error rate measured in a left direction 560 is 0.33%, a packet error rate measured in a left 45° direction 565 is 0.45%, and a packet error rate measured in a central direction 570 is 0.0357%. A packet error rate measured in a right 45° direction 575 is 0.0215%, and a packet error rate measured in a right direction 580 is 0.0371%.

Table 1 below shows the measured values described with reference to FIGS. 5A and 5B.

TABLE 1

| | Left Direction | Left 45° Direction | Central Direction | Right 45° Direction | Right Direction |
|---|---|---|---|---|---|
| Conventional System | 0.13% | 1.13% | 0.83% | 1.77% | 39.71% |
| Present Invention | 0.33% | 0.45% | 0.0357% | 0.0215% | 0.0371% |

As shown in Table 1, compared to a system using a conventional dipole type UWB antenna, in a system using a UWB antenna having a 270° coverage according to exemplary embodiments of the present invention, a packet error rate measured in a left direction is increased by 0.2%, and packet error rates measured in the other directions are reduced. In particular, a packet error rate measured in a right direction is reduced from 39.71% to 0.0371%.

As described above, according to exemplary embodiments of the present invention, communications can be performed even in a null area in which communications are impossible. Also, a 270° coverage can be secured using only two antennas. In addition, a UWB antenna having a 270° coverage according to exemplary embodiments of the present invention can be realized as a substrate type. Thus, the UWB antenna can be inserted into a narrow space of an upper or lower surface of an electronic device without a great space.

The foregoing embodiments are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. An ultra wide band antenna system comprising:

a first ultra wide band antenna comprising a dielectric substrate, two Vivaldi horn radiators attached to the dielectric substrate and comprising central axes orthogonal to each other, and a single radiator coupled to the two Vivaldi horn radiators; and a second ultra wide band antenna comprising a dielectric substrate, two Vivaldi horn radiators attached to the dielectric substrate and comprising central axes orthogonal to each other, and a single radiator coupled to the two Vivaldi horn radiators, positioned on an identical plane to the first ultra wide band antenna, wherein the second ultra wide band antenna forms a line symmetric structure together with the first ultra wide band antenna.

2. The ultra wide band antenna system of claim 1, wherein a distance between the first and second ultra wide band antennas is adjustable.

3. The ultra wide band antenna system of claim 1, wherein in the line symmetric structure, the two Vivaldi horn radiators each have a 270° coverage.

4. The ultra wide band antenna system of claim 1, wherein the first and second ultra wide band antennas horizontally rotate depending on communication environments.

5. The ultra wide band antenna system of claim 1, wherein, in each of the first and second ultra wide band antenna, a central axis of a first one of the two Vivaldi horn radiators is orthogonal to a first side of the respective ultra wide band antenna and a central axis of a second one of the two Vivaldi horn radiators is orthogonal to a second side of the respective ultra wide band antenna and is parallel to the first side of the respective ultra wide band antenna, wherein the first and second sides correspond to edges of an outer boundary of the respective ultra wide band antenna.

6. The ultra wide band antenna system of claim 5, wherein the central axis of the first Vivaldi horn radiator corresponds to an axis extending through a slot formed in a center between curved conductors of the first horn radiator.

7. The ultra wide band antenna system of claim 5, wherein the central axis of the second Vivaldi horn radiator corresponds to an axis extending through a slot formed in a center between curved conductors of the second horn radiator.

8. The ultra wide band antenna system of claim 5, wherein the outer boundary forms a rectangular shape.

9. A settop box comprising the ultra wide band antenna system which radiates a signal, the ultra wide band antenna system comprising:

a first ultra wide band antenna comprising a dielectric substrate, two Vivaldi horn radiators attached to the dielectric substrate and comprising central axes orthogonal to each other, and a single radiator coupled to the two Vivaldi horn radiators; and a second ultra wide band antenna comprising a dielectric substrate, two Vivaldi horn radiators attached to the dielectric substrate and comprising central axes orthogonal to each other, and a single radiator coupled to the two Vivaldi horn radiators, positioned on an identical plane to the first ultra wide band antenna, wherein the second ultra wide band antenna forms a line symmetric structure together with the first ultra wide band antenna.

10. The set top box of claim 9, wherein a distance between the first and second ultra wide band antennas is adjustable.

11. The set top box of claim 9, wherein in the line symmetric structure, the two Vivaldi horn radiators each have a 270° coverage.

12. The set top box of claim 9, wherein the first and second ultra wide band antennas horizontally depending on communication environments.

* * * * *